US005971603A

United States Patent [19]

Davis et al.

[11] Patent Number: 5,971,603

[45] Date of Patent: Oct. 26, 1999

[54] STATIC MIXER HEAD

[75] Inventors: Bruce Davis, Oregon; Paul J. Gramann; Tim A. Osswald, both of Madison, all of Wis.

[73] Assignee: The Madison Group: Polymer Processing Research Corp., Madison, Wis.

[21] Appl. No.: 09/065,949

[22] Filed: Apr. 24, 1998

Related U.S. Application Data

[60] Provisional application No. 60/077,113, Mar. 6, 1998.

[51] Int. Cl.[6] ..... B01F 5/06

[52] U.S. Cl. ..... 366/337; 366/338

[58] Field of Search ..... 366/87, 336–338, 366/181.5; 48/189.4; 138/37–40, 42

[56] References Cited

U.S. PATENT DOCUMENTS

| | | | |
|---|---|---|---|
| 3,671,208 | 6/1972 | Madsker | 48/189.4 |
| 3,929,318 | 12/1975 | Saidla . | |
| 4,099,268 | 7/1978 | Luthi | 366/338 |
| 4,255,124 | 3/1981 | Baranowski, Jr. . | |
| 4,461,579 | 7/1984 | McCallum | 366/337 |
| 4,721,560 | 1/1988 | York et al. . | |
| 4,793,247 | 12/1988 | Verweij | 366/336 |
| 4,848,920 | 7/1989 | Heathe et al. | 366/339 |
| 4,874,249 | 10/1989 | Kabátek et al. | 366/339 |
| 4,929,088 | 5/1990 | Smith | 366/337 |
| 5,425,581 | 6/1995 | Palm | 366/339 |
| 5,620,252 | 4/1997 | Maurer | 366/337 |

FOREIGN PATENT DOCUMENTS

| | | | |
|---|---|---|---|
| 45-40634 | 12/1970 | Japan | 366/338 |
| 55-16696 | 5/1980 | Japan | 366/337 |
| 1781049 | 12/1992 | U.S.S.R. | 366/338 |

*Primary Examiner*—Charles E. Cooley
*Attorney, Agent, or Firm*—Michael Best & Friedrich LLP

[57] ABSTRACT

A static mixer head that provides not only distributive mixing, but also dispersive mixing. Distributive mixing is accomplished by providing a series of baffles along the length of the mixing tube, each baffle being angled relative to the previous baffle. Dispersive mixing is accomplished by utilizing baffles that define a converging pathway for the mixing materials. The converging pathway promotes elongation and corresponding dispersion of the mixing materials. In one embodiment, the baffles are teardrop-shaped, and are arranged so that multiple baffles are generally parallel and adjacent to one another. Preferably, the baffles are oriented such that the mixing materials flow from the small tail portion of the baffles toward the larger head portion of the baffles, thereby encountering a gradual compressive force and corresponding elongation.

12 Claims, 3 Drawing Sheets

STATIC MIXER HEAD

This application claims the benefit of U.S. Provisional Application No. 60/077,113, filed Mar. 06, 1998.

FIELD OF THE INVENTION

The present invention generally relates to machines for mixing materials, and more specifically, to static mixer heads.

BACKGROUND OF THE INVENTION

When combining two dissimilar materials to form a new compound, it is important to adequately mix the two materials. In general, mixing can be defined as a process to reduce the non-uniformity of a composition. The basic mechanism involved is to induce physical motion to the ingredients. When performing mixing operations, two types of mixing are important: distributive mixing and dispersive mixing.

Distributive mixing refers to the increase in randomness of the spatial distribution of the particles, regardless of the size of these particles. An example of distributive mixing is the manufacture of polymer blends, where the viscosities of the components are reasonably close together.

Dispersive mixing refers to processes that reduce the size of particles. In dispersive mixing, solid components, such as agglomerates or high-viscosity droplets, are exposed to sufficiently high stresses to cause them to exceed their yield stress, and they are thus broken down into smaller particles. The size and shape of the agglomerates and the nature of the bonds holding the agglomerates together will determine the amount of stress required to break up the agglomerates. The applied stress can either be shear stress or elongational stress. In general, elongational stress is more efficient in achieving dispersion than is shear stress. An example of dispersive mixing is the manufacture of color concentrate where the breakdown of pigment agglomerates below a certain critical size is crucial.

One type of mixer is called a static mixer. Static mixers commonly include a series of deflecting baffles and/or barriers through which the mixing materials are forced. Static mixers are often used to divide and recombine the mixing materials to intermingle the materials and eliminate variations in temperature, composition and mixing history. Prior art static mixers do not provide regions of high stress, and thus are used for distributive mixing as opposed to dispersive mixing. In addition, many prior art static mixers include dead zones where material stagnation can occur, resulting in material degradation.

SUMMARY OF THE INVENTION

The present invention provides a static mixer head that provides not only distributive mixing but also dispersive mixing. Distributive mixing is accomplished by providing a series of baffles along the length of the mixing tube, each baffle being angled relative to the previous baffle. Dispersive mixing is accomplished by utilizing baffles that define a converging pathway for the mixing materials. The converging pathway promotes elongation and corresponding dispersion of the mixing materials.

In one embodiment, the baffles are teardrop-shaped, and are arranged so that multiple baffles are generally parallel and adjacent to one another. Preferably, the baffles are oriented such that the mixing materials flow from the small tail portion of the baffles toward the larger head portion of the baffles, thereby encountering a gradual compressive force and corresponding elongation. The positions and dimensions of the various baffles will vary slightly depending on the materials being mixed and the corresponding stresses required to achieve adequate dispersion of the materials.

By virtue of the present invention, both distributive and dispersive mixing can be accomplished using a static mixer head, thereby eliminating the need for more complicated dynamic mixing devices such as rotary or screw-type mixers.

DETAILED DESCRIPTION

Figure 1:
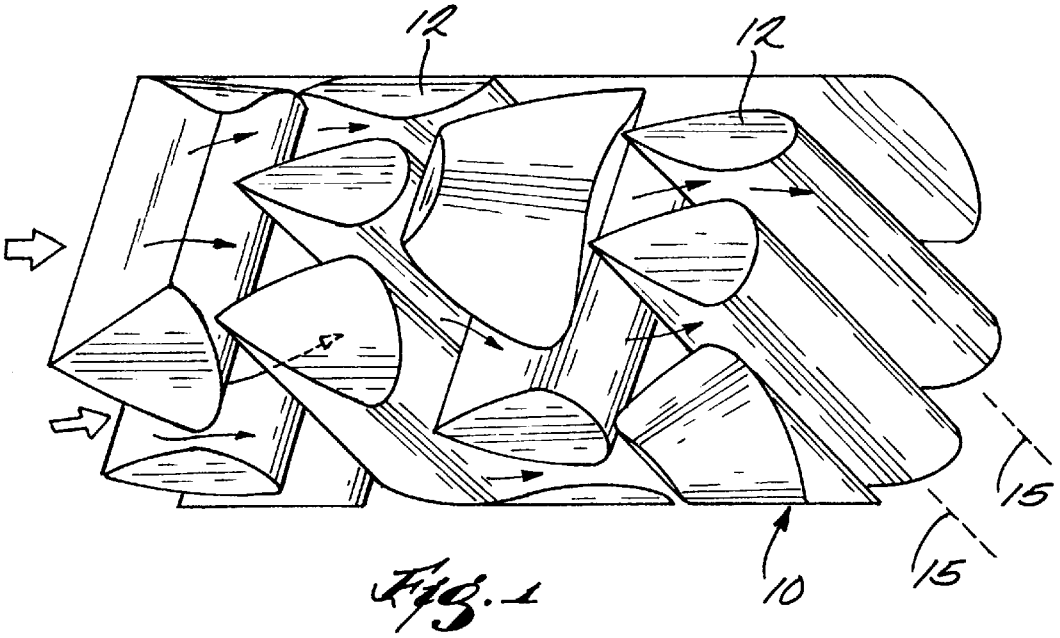
FIG. 1 is a front perspective view of a static mixer head embodying the present invention.
Figure 2:
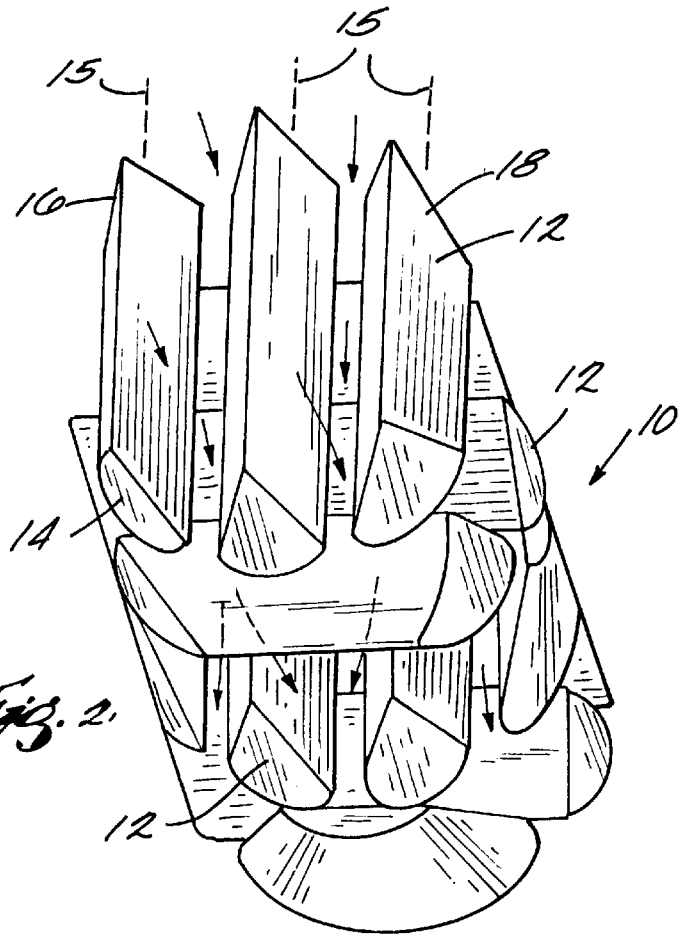
FIG. 2 is a rear perspective view of the static mixer head of FIG. 1.
Figure 3:
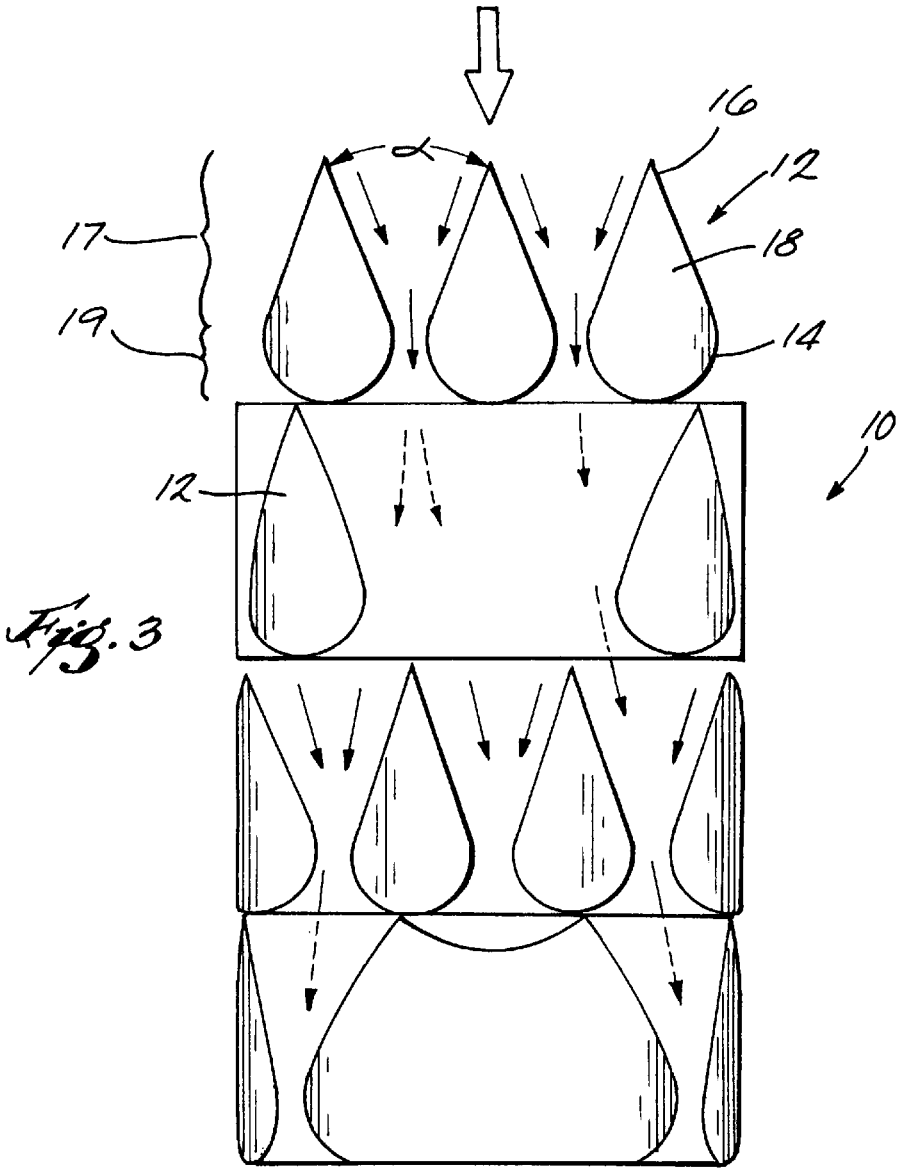
FIG. 3 is a side view of the static mixer head of FIG. 1.
Figure 4:
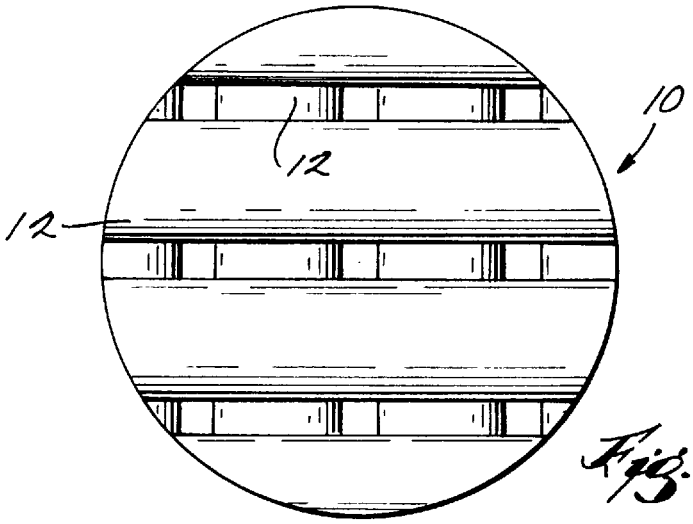
FIG. 4 is a front view of the static mixer head of FIG. 1.

The static mixer head 10 illustrated in FIGS. 1–5 is designed to be positioned within a mixing tube, which is not shown in the drawings for purposes of clarity. Mixing tubes are commonly cylindrical in shape, but the concepts of the present invention are applicable to mixing tubes of various shapes.

The static mixer head 10 includes a series of mixing baffles 12 arranged in rows. In the embodiment illustrated in FIGS. 1–5, each mixing baffle 12 is teardrop-shaped and includes a large rounded head portion 14 on one end and a small tail portion 16 on the opposing end. The head portion 14 and tail portion 16 are interconnected by a gradually diverging portion 18. Each baffle 12 defines a longitudinal axis 15 that is parallel to the longitudinal axis(es) of the other baffle(s) in the same row.

The head portion 14 of each of the illustrated baffles 12 is semi-cylindrical in shape. The diameter of the head portion 14 is dimensioned to be the same as the maximum width of the baffle 12 so that a smooth transition occurs between the diverging portion 18 and the head portion 14. The large diameter head portion facilitates smooth flow of mixing material through the mixer with reduced dead zones (i.e., reduced stagnation).

The illustrated baffles 12 are positioned within the mixing tube so that they are parallel to and slightly spaced from the other baffles within the same row. The baffles are oriented relative to the material flow (illustrated by arrows) such that the material passes between the baffles from the tail portion 16 to the head portion 14. In this orientation, the tail portion 16 and diverging portion 18 of each baffle form an upstream portion 17, while the head portion 14 forms a downstream portion 19. With the above-described orientation of the baffles 12, it can be seen that the diverging portions 18 of adjacent baffles 12 form a converging pathway at a converging angle $\alpha$ (FIG. 3) through which the mixing materials will flow. This converging pathway provides compressive forces on the mixing materials, resulting in elongation and dispersion of the mixing materials. It should be appreciated that there are other orientations of the baffles that could also form the desired converging pathway. For example, instead of the illustrated straight walls of the diverging portion 18, the converging pathway could instead be formed by curved walls that achieve the same elongational results.

The precise dimensions of the mixer head will vary depending on the materials to be mixed and the size of the mixing tube. For example, the length, width, and number of baffles can be chosen to meet specific needs. Furthermore, the converging angle and the gap (i.e., at the narrowest point) between adjacent baffles can further be varied to achieve different compressive and elongation forces.

In the illustrated embodiment, the converging angle $\alpha$ is between about 14 degrees and about 100 degrees. Preferably, the converging angle is between about 20 degrees and about 80 degrees, and more preferably the converging angle is between about 40 degrees and about 70 degrees. In addition, the ratio of the baffle gap to the baffle width (i.e., the gap:width ratio) is preferably between about 1:7 and about 2:5.

Adjacent rows of the baffles 12 are transverse (e.g., rotated) relative to each other in order to facilitate distributive mixing. More specifically, the illustrated longitudinal axes 15 of the baffles 12 of one row are angled about 90° relative to the longitudinal axes 15 of the adjacent rows. With this design, it can be seen that the baffles 12 of non-adjacent rows will be parallel to each other. In addition to being parallel, the baffles 12 of non-adjacent rows are staggered slightly to further promote distributive mixing. It should be appreciated that the angular change of the baffles 12 could be less than 90°, such as 45°, thereby promoting a more gradual twisting of the mixing materials.

In addition to promoting compression and elongation of the mixing materials, the teardrop-shaped baffles 12 also reduce the amount of dead zones within the mixer head 10. Mixer heads typically include dead zones within sharp corners, and particularly in transition regions with concave portions that face downstream. The illustrated baffles 10 alleviate this problem by providing downstream portions 19 that are generally convex in shape (e.g., the rounded head portions 14). The rounded head portions 14 promote flow around the downstream end of the baffles 12 to reduce the amount of dead zones within the mixer head 10.

Figure 6:
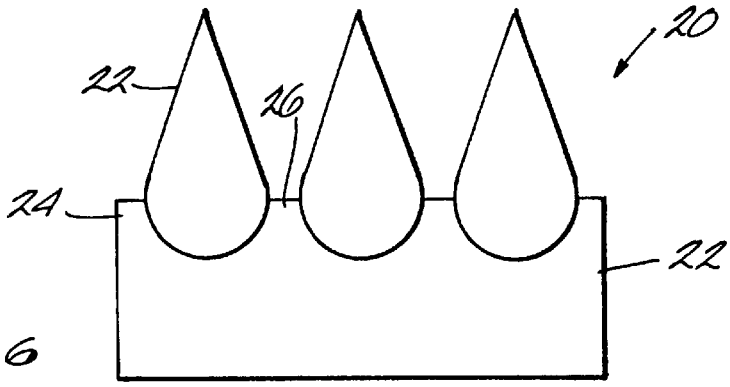
FIG. 6 is a side view of two rows of baffles from an alternative embodiment of the present invention.
Figure 5:
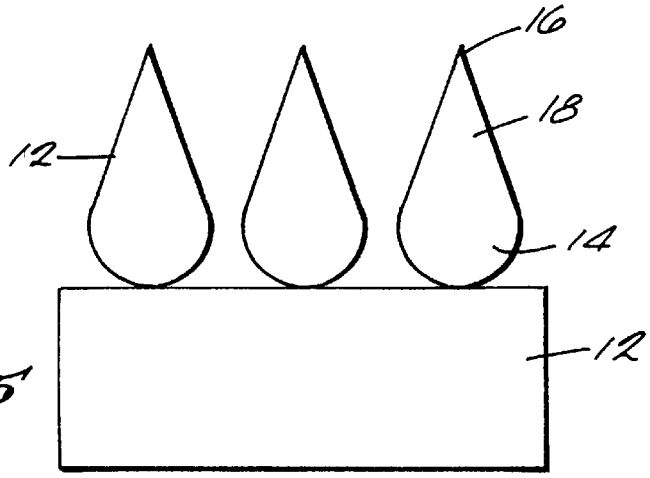
FIG. 5 is a side view of two rows of baffles from the static mixer head illustrated in FIG. 1.

The mixer head 20 illustrated in FIG. 6 is believed to further reduce the amount of dead zones by overlapping the baffles 22 of one row with the baffles 22 of the adjacent row. By doing this, the amount of downstream dead zones is believed to be further reduced. In the illustrated embodiment, the tail portion 24 of one row of baffles 22 is positioned approximately at the point of maximum compression 26 of the previous row of baffles 22. Such positioning of the baffles forces the mixing materials to pass immediately from the zone of maximum compression of one row of baffles into the compression zone of the next row of baffles. This is believed to further enhance the elongation and dispersive mixing of the materials.

Figure 7:
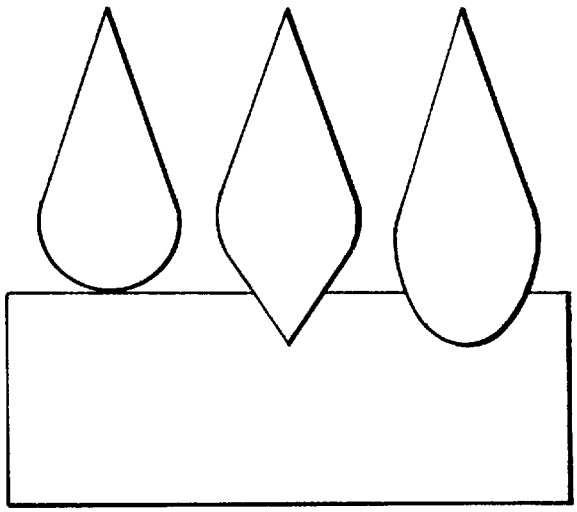
FIG. 7 illustrates alternative baffle shapes.

FIG. 7 illustrates some alternative baffle shapes, and specifically some alternative head portion shapes. For example, the head portion 30 could have a semi-elliptical or semi-oval shape, which provides a more gradual downstream transition zone and is believed to further reduce material stagnation. Alternatively, the head portion 32 could be pointed, which provides a constant downstream expanding angle.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A static mixer head for mixing materials, said mixer head comprising a plurality of rows of baffles, each row including a plurality of baffles and each baffle defining a longitudinal axis that is parallel to the longitudinal axis of another baffle in the same row, wherein the longitudinal axes of the baffles in one row are transverse to the longitudinal axes of the baffles in an adjacent row, and wherein each baffle includes:

an upstream portion; and a downstream portion having a convex shape.

2. A static mixer head as claimed in claim 1, wherein the axes of one row of baffles are rotated about 90° relative to the axes of the baffles in an adjacent row.

3. A static mixer head as claimed in claim 1, wherein the axes of the baffles in one row are parallel to the axes of the baffles in a non-adjacent row.

4. A static mixer head as claimed in claim 1, wherein said baffles are substantially teardrop in shape.

5. A static mixer head as claimed in claim 1, wherein baffles in one row overlap with baffles of an adjacent row.

6. A static mixer head as claimed in claim 1, wherein said downstream portion is semi-cylindrical in shape.

7. A static mixer head as claimed in claim 1, wherein said downstream portion is semi-elliptical in shape.

8. A static mixer head for mixing materials, said mixer head comprising a plurality of rows of baffles, each row including a plurality of baffles and each baffle defining a longitudinal axis that is parallel to the longitudinal axis of another baffle in the same row, wherein the longitudinal axes of the baffles in one row are parallel and staggered relative to the longitudinal axes of the baffles in a non-adjacent row, and wherein each baffle includes:

an upstream portion; and a downstream portion having a convex shape.

9. A static mixer head as claimed in claim 8, wherein said baffles are substantially teardrop in shape.

10. A static mixer head as claimed in claim 8, wherein baffles in one row overlap with baffles of an adjacent row.

11. A static mixer head as claimed in claim 8, wherein said downstream portion is semi-cylindrical in shape.

12. A static mixer head as claimed in claim 8, wherein said downstream portion is semi-elliptical in shape.

* * * * *